US007614201B2

(12) United States Patent
Cabanski et al.

(10) Patent No.: US 7,614,201 B2
(45) Date of Patent: Nov. 10, 2009

(54) SHEET METAL JOINT

(75) Inventors: John L. Cabanski, Mount Prospect, IL (US); Thomas O. Zurfluh, Evanston, IL (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 641 days.

(21) Appl. No.: 11/242,692

(22) Filed: Oct. 4, 2005

(65) Prior Publication Data

US 2007/0094983 A1 May 3, 2007

(51) Int. Cl.

| | |
|---|---|
| ***E04C 2/54*** | (2006.01) |
| ***E04C 2/32*** | (2006.01) |
| ***E04C 2/34*** | (2006.01) |
| ***B32B 15/00*** | (2006.01) |
| ***B21D 31/04*** | (2006.01) |
| ***B21D 13/00*** | (2006.01) |
| ***B21D 39/00*** | (2006.01) |
| ***B23K 20/12*** | (2006.01) |
| ***B23P 11/00*** | (2006.01) |
| ***F16B 21/00*** | (2006.01) |

(52) U.S. Cl. ..... 52/791.1; 52/783.1; 428/594; 428/597; 428/598; 72/186; 29/505; 29/509; 29/513; 403/329

(58) Field of Classification Search ..... 52/127.5, 52/791.1, 789.1, 783.1, 796.1, 792.11, 793.11, 52/799.1; 138/166, 168; 29/21.1, 513, 521, 29/505, 509, 897.32; 428/133, 134, 136, 428/594, 597, 598; 403/326, 329; 72/186, 72/325

See application file for complete search history.

(56) References Cited

U.S. PATENT DOCUMENTS

| | | | | | |
|---|---|---|---|---|---|
| 45,536 | A | * | 12/1864 | Terwilliger et al. | 109/85 |
| 184,397 | A | * | 11/1876 | Macumber | 29/21.1 |
| 384,118 | A | * | 6/1888 | Bellinger | 52/525 |
| 430,000 | A | * | 6/1890 | Clark et al. | 29/509 |

(Continued)

FOREIGN PATENT DOCUMENTS

| | | |
|---|---|---|
| DE | 39 33 765 | 4/1991 |

(Continued)

OTHER PUBLICATIONS

English language Abstract for DE 39 33 765 A1 extracted from espacenet.com database dated Oct. 4, 2005.

(Continued)

*Primary Examiner*—Robert J Canfield
*Assistant Examiner*—Charissa Ahmad
(74) *Attorney, Agent, or Firm*—Robert L. Stearns; Dickinson Wright PLLC

(57) ABSTRACT

The invention provides a sheet metal joint and a method for forming a sheet metal joint. The sheet metal joint includes first and second metal sheets disposed in a parallel relation to one another. Each of the first and second metal sheets has a plurality of perforations with a tang extending from each perforation. The tangs of the second sheet and the tangs of the second metal sheet are curled together in opposite rotational directions. The tangs of the first metal sheet space the first and second metal sheets from one another and the tangs of the second metal sheet substantially fixedly engage the first and second metal sheets with respect to one another.

5 Claims, 3 Drawing Sheets

U.S. PATENT DOCUMENTS

| | | | | | |
|---|---|---|---|---|---|
| 518,767 | A | * | 4/1894 | Plecker | 29/513 |
| 548,483 | A | * | 10/1895 | Vogel | 24/20 EE |
| 767,798 | A | * | 8/1904 | Clark | 428/596 |
| 804,799 | A | * | 11/1905 | Edison | 72/186 |
| 945,682 | A | * | 1/1910 | Berg | 52/588.1 |
| 1,296,272 | A | * | 3/1919 | Doble | 428/594 |
| 1,352,656 | A | * | 9/1920 | Cahill | 160/232 |
| 1,368,490 | A | * | 2/1921 | Dieckmann | 428/594 |
| 1,496,961 | A | * | 6/1924 | Welsch et al. | 224/42.37 |
| 1,650,518 | A | * | 11/1927 | Humphris | 428/597 |
| 1,652,331 | A | * | 12/1927 | Sebell | 220/377 |
| 1,968,365 | A | * | 7/1934 | Bailey | 428/133 |
| 1,980,154 | A | * | 11/1934 | Coe | 403/283 |
| 1,997,987 | A | * | 4/1935 | Victor, Jr. | 428/133 |
| 2,023,059 | A | * | 12/1935 | Vaughan | 24/20 EE |
| 2,024,369 | A | | 12/1935 | Kaiser | |
| 2,173,730 | A | * | 9/1939 | Schmied | 83/140 |
| 2,321,755 | A | * | 6/1943 | Kost | 52/592.3 |
| 2,359,205 | A | * | 9/1944 | Cowan | 428/133 |
| 2,426,670 | A | * | 9/1947 | Cooley | 29/21.1 |
| 2,625,723 | A | * | 1/1953 | Bassett | 24/703.3 |
| 2,663,072 | A | * | 12/1953 | Pfistershammer | 29/521 |
| 2,702,103 | A | * | 2/1955 | Pfistershamer | 52/848 |
| 2,733,177 | A | * | 1/1956 | Meyer | 428/49 |
| 2,754,581 | A | * | 7/1956 | Thomas | 72/186 |
| 2,772,757 | A | * | 12/1956 | Hammond | 52/666 |
| 2,812,813 | A | * | 11/1957 | Zarnowski | 160/235 |
| 2,901,816 | A | * | 9/1959 | Smith et al. | 29/21.1 |
| 2,912,075 | A | * | 11/1959 | Pfistershammer | 52/834 |
| 2,916,181 | A | * | 12/1959 | Pfister et al. | 220/62 |
| 3,008,551 | A | * | 11/1961 | Cole | 428/132 |
| 3,010,199 | A | * | 11/1961 | Smith et al. | 29/509 |
| 3,082,850 | A | * | 3/1963 | Weening | 52/127.5 |
| 3,083,773 | A | * | 4/1963 | Nagel et al. | 166/176 |
| 3,210,815 | A | * | 10/1965 | Breuning | 24/20 EE |
| 3,376,684 | A | * | 4/1968 | Cole et al. | 52/635 |
| 3,462,805 | A | | 8/1969 | Quisling | |
| 3,465,414 | A | * | 9/1969 | Koett | 29/432.2 |
| 3,517,589 | A | * | 6/1970 | Jacob et al. | 493/390 |
| 3,728,881 | A | * | 4/1973 | Coop | 72/52 |
| 3,793,791 | A | * | 2/1974 | Wootten | 52/789.1 |
| 3,824,757 | A | * | 7/1974 | Coop | 138/166 |
| 3,846,218 | A | * | 11/1974 | Wootten | 428/132 |
| 3,924,378 | A | * | 12/1975 | Hafner | 403/274 |
| 3,953,634 | A | * | 4/1976 | Wootten | 428/133 |
| 3,999,924 | A | * | 12/1976 | Tanaka | 425/306 |
| 4,039,708 | A | * | 8/1977 | Okada | 428/73 |
| 4,279,066 | A | * | 7/1981 | Riley | 29/890.033 |
| 4,599,771 | A | * | 7/1986 | Trenkler et al. | 29/897.32 |
| 4,679,367 | A | * | 7/1987 | Geisthardt | 52/233 |
| 4,776,602 | A | | 10/1988 | Gallo | |
| 4,805,592 | A | * | 2/1989 | Enami | 126/273 R |
| 4,911,972 | A | * | 3/1990 | Mercuri | 428/99 |
| 5,172,920 | A | * | 12/1992 | Schlenk | 277/654 |
| 5,656,353 | A | * | 8/1997 | Butler | 428/133 |
| 5,672,405 | A | * | 9/1997 | Plank et al. | 428/133 |
| 5,678,946 | A | * | 10/1997 | Enami | 403/282 |
| 6,209,202 | B1 | * | 4/2001 | Rhodes et al. | 29/890.053 |
| 6,258,431 | B1 | | 7/2001 | Reis et al. | |
| 6,268,037 | B1 | * | 7/2001 | Butler et al. | 428/100 |
| 6,314,633 | B1 | * | 11/2001 | Norkus et al. | 29/448 |
| 7,374,810 | B2 | * | 5/2008 | Durney et al. | 428/136 |
| 2002/0108422 | A1 | * | 8/2002 | Sugikawa | 72/186 |
| 2004/0012178 | A1 | | 1/2004 | Wisniewski | |
| 2005/0044915 | A1 | * | 3/2005 | Shimizu et al. | 72/186 |

FOREIGN PATENT DOCUMENTS

| | | |
|---|---|---|
| JP | 57190737 | 11/1982 |
| JP | 57190738 | 11/1982 |

OTHER PUBLICATIONS

English language Abstract for JP 57190737 extracted from espacenet.com database dated Oct. 4, 2005.
English language Abstract for JP 57190738 extracted from espacenet.com database dated Oct. 4, 2005.

* cited by examiner

SHEET METAL JOINT

BACKGROUND OF THE INVENTION

1. Field of the Invention

The invention relates to sheet metal joint and a method of joining at least two metal sheets.

2. Description of Related Art

The construction of a joint between metal sheets can be accomplished by overlapping and folding the ends of the sheets. Alternatively, the sheets can be formed with tangs that are folded over one another. This type of joint is disclosed in U.S. Pat. No. 3,824,757. Alternatively, the sheets can be formed with holes that are aligned and then folded over one another. This type of joint is disclosed in U.S. Pat. No. 3,082,850.

SUMMARY OF THE INVENTION

The invention provides a sheet metal joint and a method for forming a sheet metal joint. The sheet metal joint includes first and second metal sheets disposed in parallel relation to one another. Each of the first and second metal sheets has a plurality of perforations with a tang extending from each perforation. The tangs of the first sheet and the tangs of the second metal sheet are curled together in opposite rotational directions. The tangs of the first metal sheet space the first and second metal sheets from one another and the tangs of the second metal sheet substantially fixedly engage the first and second metal sheets with respect to one another.

BRIEF DESCRIPTION OF THE DRAWINGS

Advantages of the present invention will become more readily appreciated when considered in connection with the following detailed description and appended drawings, wherein.

DETAILED DESCRIPTION OF THE PREFERRED EMBODIMENT

Figure 1:
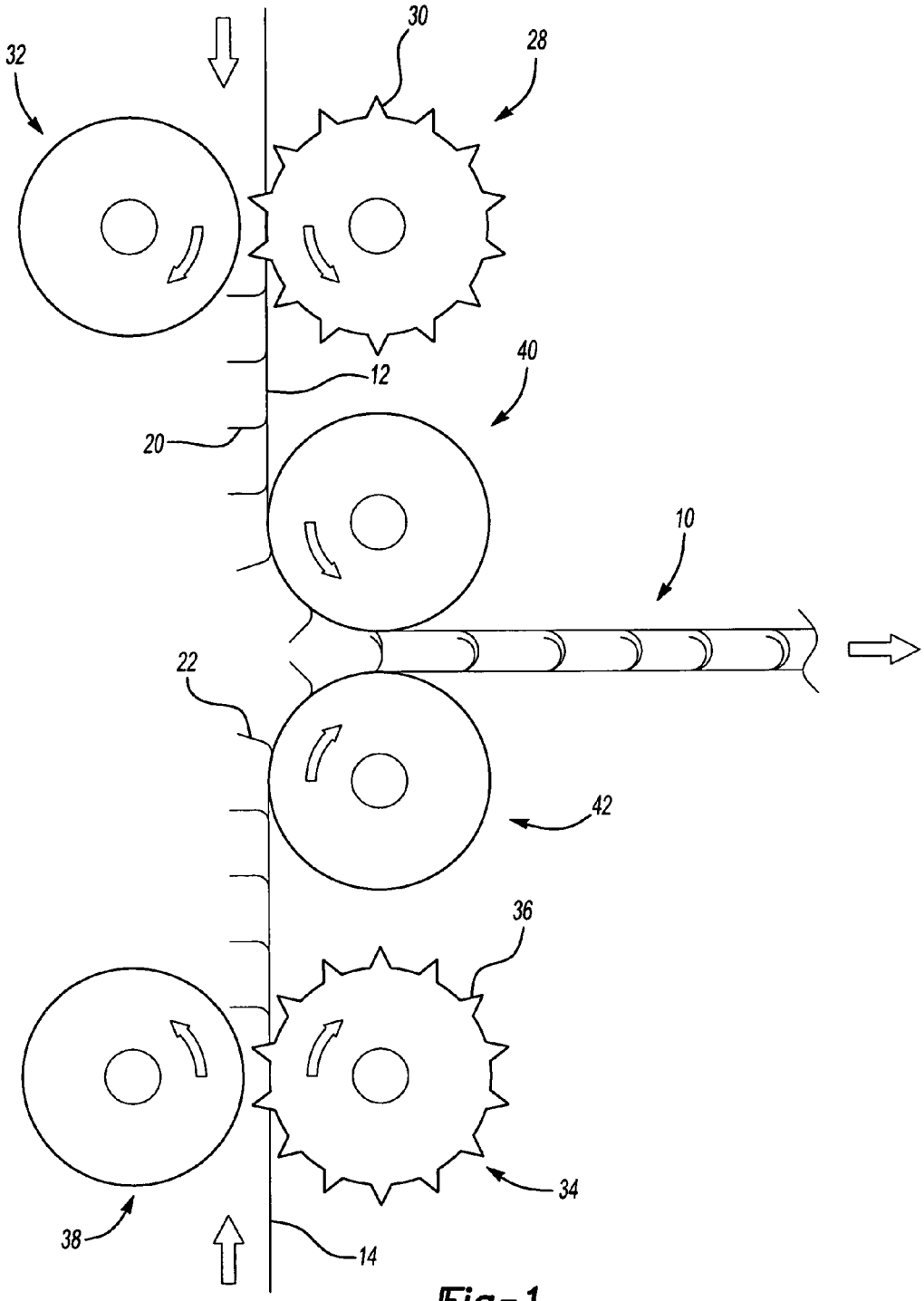
FIG. 1 is a schematic side view of an arrangement for forming a sheet metal joint according to an exemplary embodiment of the invention.

A plurality of different embodiments of the invention are shown in the Figures of the application. Similar features are shown in the various embodiments of the invention. Similar features have been numbered with a common two-digit reference numeral and have been differentiated by a third digit placed before the two common digits. Also, to enhance consistency, features in any particular drawing share the same two digit designation even if the feature is shown in less than all embodiments. Similar features are structured similarly, operate similarly, and/or have the same function unless otherwise indicated by the drawings or this specification. Furthermore, particular features of one embodiment can replace corresponding features in another embodiment unless otherwise indicated by the drawings or this specification.

Figure 2:
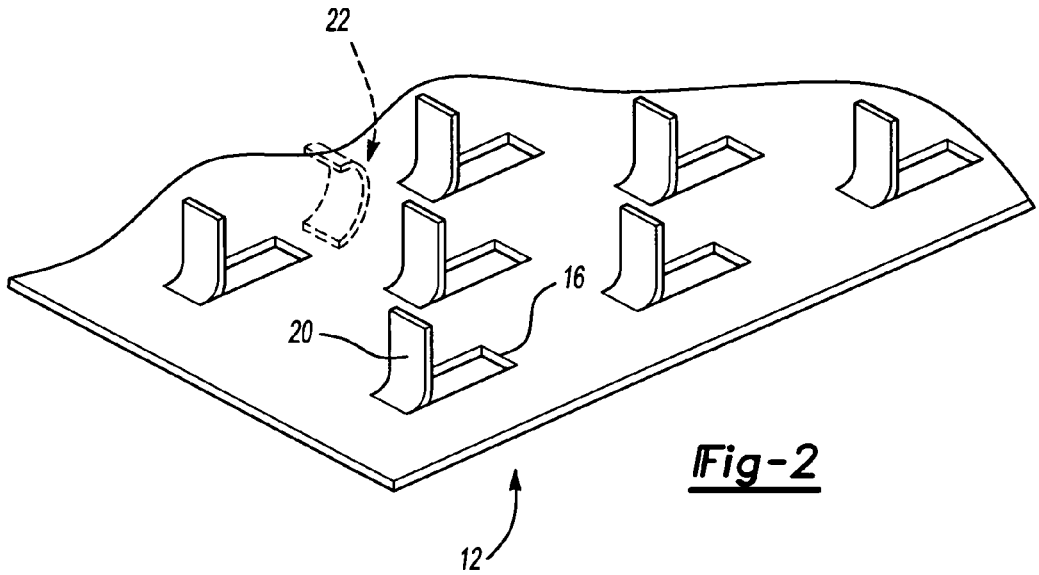
FIG. 2 is a perspective view of a sheet having perforations according to an exemplary embodiment of the invention.
Figure 3:
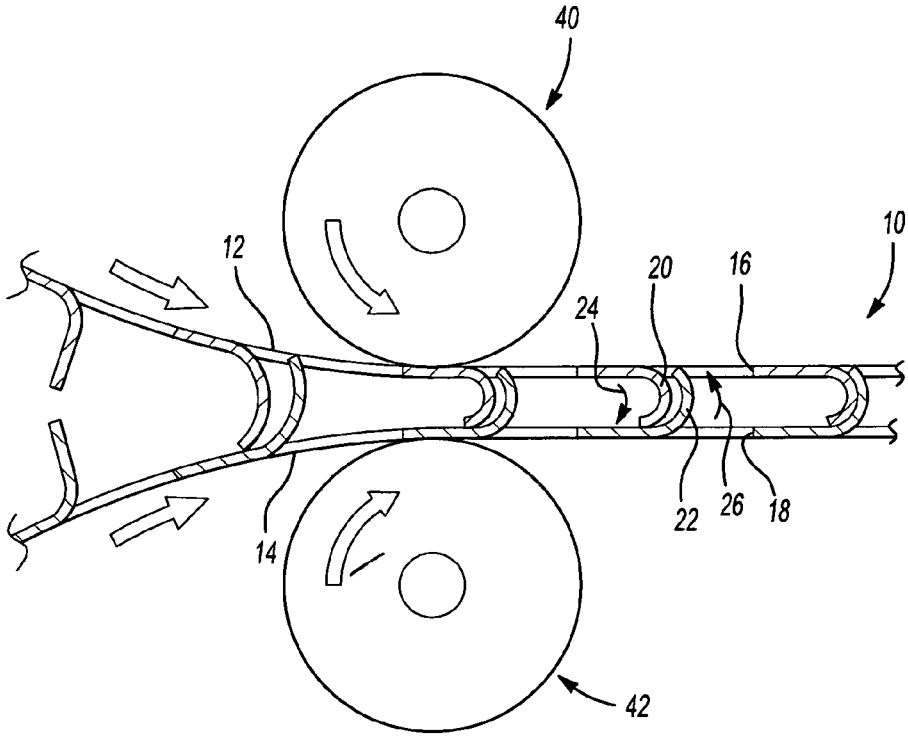
FIG. 3 is a schematic side view of an arrangement for engaging two metal sheets according to an exemplary embodiment of the invention.

The invention provides a sheet metal joint 10 and a method for forming a sheet metal joint 10. Referring to FIGS. 1-3, the sheet metal joint 10 includes first and second metal sheets 12, 14 disposed in parallel relation to one another. Each of the first and second metal sheets 12, 14 has a plurality of perforations 16, 18, respectively, with a tang 20, 22 extending from each perforation 16, 18. The tangs 20 of the first metal sheet 12 and the tangs 22 of the second metal sheet 14 are curled together in opposite rotational directions 24, 26. The tangs 20 of the first metal sheet 12 space the first and second metal sheets 12, 14 from one another and the tangs 22 of the second metal sheet 14 substantially fixedly engage the first and second metal sheets 12, 14 with respect to one another.

In an exemplary embodiment of the invention, the tangs 22 of the second metal sheet 14 could extend around the tangs 20 of first metal sheet 12 and through the perforations 16 of the first metal sheet. Also, the tangs 22 of the second metal sheet 14 could be wider than the perforations 16 of the first metal sheet 12. In such an embodiment of the invention, the tangs 22 of the second metal sheet 14 (shown in phantom in FIG. 2) would be deformed for insertion into the perforations 16 of the first metal sheet 12.

It is noted that either the tangs 22 of the second metal sheet 14 can circle the tangs 20 of the first metal sheet 12, as shown in FIG. 3, or the tangs 20 of the first metal sheet 12 can circle the tangs 22 of the second metal sheet 14, as shown in FIG. 1.

FIGS. 1 and 3 show schematic side views of structure for forming the first exemplary embodiment of the sheet metal joint 10. The first metal sheet 12 is directed between a first roller 28 having a plurality of punches 30 and a second roller 32 having a plurality of recesses (not visible) to receive the punches 30. The perforations 16 and tangs 20 are formed by the cooperation between the rollers 28, 32. The second metal sheet 14 is directed between a first roller 34 having a plurality of punches 36 and a second roller 38 having a plurality of recesses (not visible) to receive the punches 36. The perforations 18 and tangs 22 are formed by the cooperation between the rollers 34, 38.

The first and second metal sheets 12, 14 are moved past the rollers 28, 32, 34, 38 to rollers 40, 42. The first metal sheet 12 is moved around the roller 40 with the tangs 20 extending away from the roller 40. The second metal sheet 14 is moved around the roller 42 with the tangs 22 extending away from the roller 42. FIGS. 1 and 3 show slightly different embodiments of structure for practicing the invention wherein, for example, FIG. 1 shows the sheets 12, 14 being directed along a ninety degree change of direction by the rollers 40 and 42 while FIG. 3 shows the sheets 12, 14 being directed along less than a ninety degree change of direction by the rollers 40 and 42. The rollers 40, 42 are spaced from one another such that the tangs 20 of the first metal sheet 12 and the tangs 22 of the second metal sheet 14 are overlapped and bent around one another during movement between the rollers 40, 42. Movement of the sheets 12, 14 and the rollers 28, 32, 34, 38 can be controlled by a controller so that the tangs 20 are properly aligned and received the tangs 22 prior to curling of the tangs 20, 22 between the rollers 40, 42.

Figure 4:
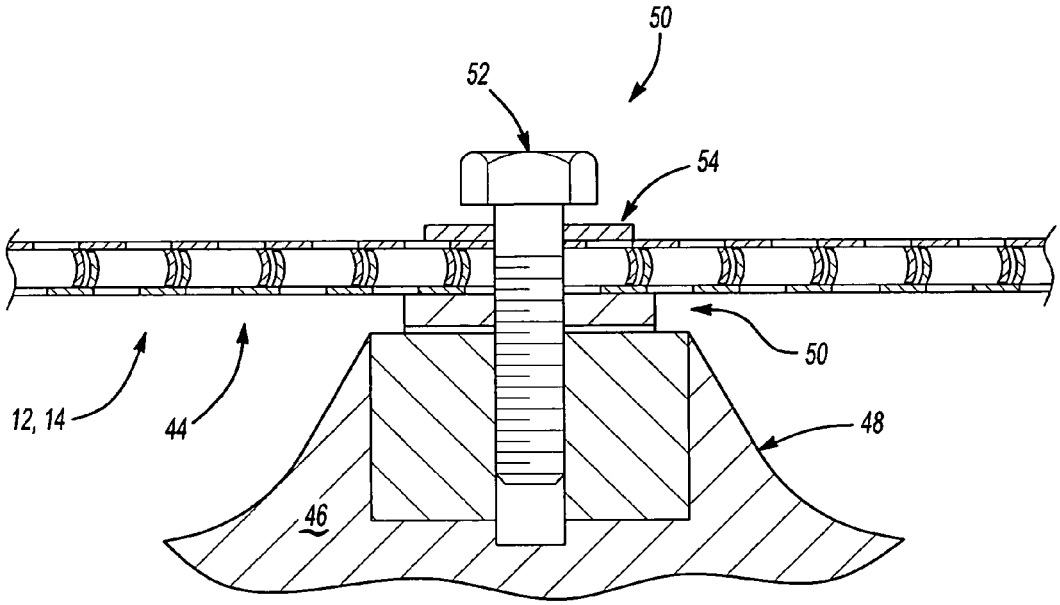
FIG. 4 is a schematic side view of a two metal sheets joined to one another in an exemplary operating environment.

FIG. 4 shows an exemplary operating environment for the joined, first and second metal sheets 12, 14. The joined, first and second metal sheets 12, 14 cooperate to define a heat shield 44. A hot component 46, such as an engine block or manifold, defines a boss 48. An isolator 50 is disposed between the heat shield 44 and the boss 48. A bolt 50 having a bolt head 52 is threadingly received in the boss 48 to fix the heat shield 44 with respect to the component 46. A washer 54 can be disposed between the heat shield 44 and the bolt head 52.

Figure 5:
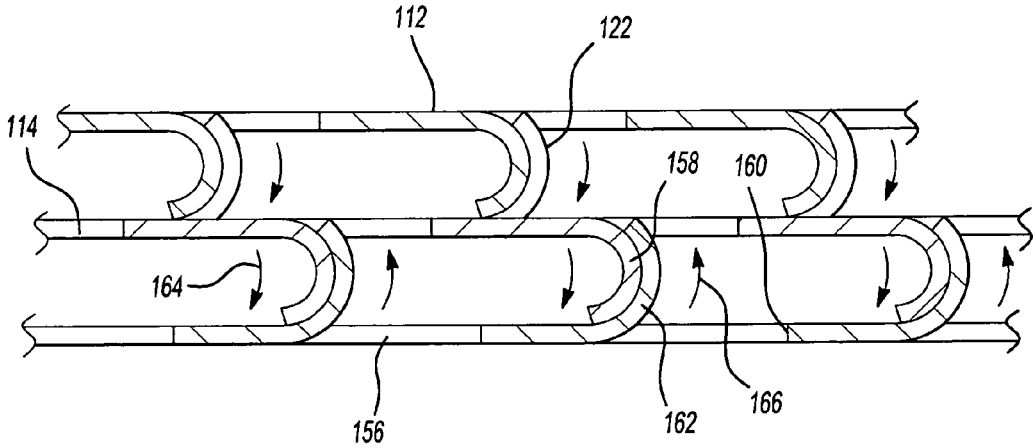
FIG. 5 is side view of an exemplary embodiment of the invention wherein three metal sheets are engaged with one another.

FIG. 5 shows another exemplary embodiment of the invention where three sheets 112, 114, 156 are engaged with one another. The second metal sheet 114 includes a first set of tangs 122 extending toward the first metal sheet 112 and a second set of tangs 158 extending away from the first metal sheet 112. A third metal sheet 156 is disposed in parallel relation with the first and second metal sheets 112, 114. The third metal sheet 156 includes a plurality of perforations 160 with a tang 162 extending from each perforation 160. The second set of tangs 158 of the second sheet 114 and the tangs 162 of the third metal sheet 156 are curled together in opposite rotational directions 164, 166. The second set of tangs 158 of the second metal sheet 114 space the second and third metal sheets 114, 156 from one another and the tangs 162 of the third metal sheet 156 substantially fixedly engage the second and third metal sheets 114, 156 with respect to one another.

In the embodiments of the application shown in the drawings, all the tangs of one sheet surrounded by the tangs of a second sheet. However, in alternative embodiments of the invention, alternating tangs of a first sheet could be surrounded by corresponding, alternating tangs of a second sheet and vice-versa. This could be done by adjusting the geometry of the perforating rollers.

Obviously, many modifications and variations of the present invention are possible in light of the above teachings. It is, therefore, to be understood that within the scope of the appended claims, the invention may be practiced otherwise than as specifically described.

What is claimed is:

1. A sheet metal joint comprising:

first and second metal sheets disposed in spaced, overlying relation and each having a plurality of perforations with a tang extending from each perforation and wherein said tangs of said second metal sheet curl around said tangs of said first metal sheet; wherein said tangs of said first metal sheet space said first and second metal sheets from one another in said spaced, overlying relation and said tangs of said second metal sheet substantially fixedly engage said first and second metal sheets with respect to one another; and said tangs of said second metal sheet extend through said perforations of said first metal sheet.

2. The sheet metal joint of claim 1 wherein said tangs of said second metal sheet are wider than said perforations of said first metal sheet and are deformed for insertion into said perforations of said first metal sheet.

3. The sheet metal joint of claim 1 wherein said second metal sheet is further defined as having a first set of tangs extending toward said first metal sheet and a second set of tangs extending away from said first metal sheet.

4. The sheet metal joint of claim 3 further comprising:

a third metal sheet disposed in spaced, overlying relation with said first and second metal sheets and having a plurality of perforations with a tang extending from each perforation and said second set of tangs of said second sheet and said tangs of said third metal sheet being curled together in opposite rotational directions.

5. The sheet metal joint of claim 4 wherein said second set of tangs of said second metal sheet space said second and third metal sheets from one another and said tangs of said third metal sheet substantially fixedly engage said second and third metal sheets with respect to one another.

* * * * *

UNITED STATES PATENT AND TRADEMARK OFFICE

CERTIFICATE OF CORRECTION

PATENT NO. : 7,614,201 B2
APPLICATION NO. : 11/242692
DATED : November 10, 2009
INVENTOR(S) : Cabanski et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1043 days.

Signed and Sealed this

Nineteenth Day of October, 2010

David J. Kappos

David J. Kappos
*Director of the United States Patent and Trademark Office*